US005357234A

United States Patent [19]

Pimpis et al.

[11] Patent Number: 5,357,234

[45] Date of Patent: Oct. 18, 1994

[54] CURRENT LIMITING FUSE

[75] Inventors: Robert M. Pimpis, Dover, N.H.; Richard J. Perreault, Amesbury, Mass.; George F. Walker, Jr., Lee, N.H.; David E. Suuronen, Newburyport, Mass.; Edward J. Knapp, Jr., Stratham, N.H.

[73] Assignee: Gould Electronics Inc., Eastlake, Ohio

[21] Appl. No.: 52,355

[22] Filed: Apr. 23, 1993

[51] Int. Cl.[5] ..... H01H 85/14

[52] U.S. Cl. ..... 337/246; 337/252; 29/623

[58] Field of Search ..... 337/228, 246, 251, 252, 337/253, 254, 263; 29/623

[56] References Cited

U.S. PATENT DOCUMENTS

| | | | |
|---|---|---|---|
| 973,250 | 10/1910 | Barricklow . | |
| 2,395,206 | 2/1946 | Wiard | 337/246 |
| 3,005,741 | 10/1961 | Hallas . | |
| 3,168,632 | 2/1965 | Baran et al. . | |
| 3,174,016 | 3/1965 | Kamminga et al. | 337/246 |
| 3,394,333 | 7/1968 | Jacobs, Jr. . | |
| 3,418,616 | 12/1968 | Grober . | |
| 3,491,322 | 1/1970 | Kozacka . | |
| 3,766,507 | 10/1973 | Jacobs, Jr. . | |
| 3,914,863 | 10/1975 | Wiebe . | |
| 4,205,431 | 6/1980 | Wiebe . | |
| 4,224,592 | 9/1980 | Urani et al. . | |
| 4,229,403 | 10/1980 | Guleserian . | |
| 4,290,183 | 9/1981 | Tait . | |
| 4,306,213 | 12/1981 | Rose . | |
| 4,328,753 | 5/1982 | Kristensen et al. . | |
| 4,344,060 | 8/1982 | Ciesemier et al. . | |
| 4,503,415 | 3/1985 | Rooney et al. . | |
| 4,580,124 | 4/1986 | Borzoni . | |
| 4,851,805 | 7/1989 | Poerschke | 337/253 |
| 4,893,107 | 1/1990 | Moner . | |
| 4,928,384 | 5/1990 | Gurevich . | |
| 4,935,716 | 6/1990 | Ehlmann . | |
| 4,949,062 | 8/1990 | Mollet . | |
| 4,949,063 | 8/1990 | Levko . | |
| 4,951,026 | 8/1990 | Ehlmann . | |
| 4,965,925 | 10/1990 | Monter . | |
| 4,972,170 | 11/1990 | Ehlmann et al. . | |

OTHER PUBLICATIONS

DSM Stanyl Application data sheets for Main-Fuse and NH-Fuse Dec. 1992.

Amodel PPA product sheets May 1991.

Amodel resins Product Data Jun. 1992.

"Joint Designs for Ultrasonic Welding", Sonics & Materials, 1989 Sonics & Materials, Inc.

*Primary Examiner*—Lincoln Donovan

*Attorney, Agent, or Firm*—Fish & Richardson

[57] ABSTRACT

A fuse that includes an insulating housing made from two housing pieces made of thermoplastic material, terminals extending through slots in the ends of the housing, and a fusible element having ends connected to both of the terminals. The housing includes a tubular portion and slotted end portions located at each of the two ends of the tubular portion. Each of the terminals has an internal portion inside the housing to which a fusible element is attached, an external portion outside of the housing, and a middle portion between the internal and external portions and located within one of the slots.

31 Claims, 4 Drawing Sheets

CURRENT LIMITING FUSE

BACKGROUND OF THE INVENTION

The invention relates to current limiting fuses.

Current limiting fuses typically have one or more fusible elements connecting two conducting terminals within an insulative housing.

One type of fuse construction employs a housing made of a tubular casing of melamine glass, cardboard, or thermoset polymer resins in a matrix with glass or papers. The ends of the tubes are typically closed with end caps, which go around the ends of the tube, or end blocks of brass or copper, which are inside of the tube at the ends. When end blocks are employed, there often are terminal blades that are located on the outer surfaces of the end blocks (being either integral with or attached such as by welding or brazing to the end blocks), and fusible elements are connected, e.g., by welding in grooves, to the inside surfaces of the end blocks.

Barricklow U.S. Pat. No. 973,250 describes a different type of fuse construction in which the insulative housing is made of two pieces that have been bolted together.

SUMMARY OF THE INVENTION

In one aspect, the invention features, in general, a fuse which includes an insulative housing that has a tubular portion and two end portions that are located at the ends of the tubular portion and have slots through which terminals pass. The housing is made from two plastic housing pieces that have been joined together. The terminals have portions inside and outside of the housing, and a fusible element located inside the housing has ends connected to each of the terminals. This approach permits reducing the number of parts and simplifies the assembly and manufacture procedure.

In preferred embodiments, the tubular portion of the housing is cylindrical, and the end portions are circular. The two housing pieces can be composed of male and female parts, or they could be composed of identical parts. Each of the slots is defined by portions on both of the housing pieces. The end portions can have wall extensions that extend perpendicularly from the end portions into the housing, partially define the slots, and strengthen the support of the terminals. The slots can be perpendicular to or aligned with the seam formed by joinder of the two housing pieces. The terminals can have internal and external portions that are wider than middle portions that are situated within the slots, thereby retaining the terminals in the slots by interference with the housing. The fusible element can be attached to the terminals by resistance welding or ultrasonic welding. The fusible element is preferably corrugated, and multiple fusible elements can be used. The voids in the housing are preferably occupied by arc-quenching fill material introduced into the housing via fill holes that are sealed with preformed metal plugs or nonconductive potting plugs after filling. The fill can be a solid fill.

In another aspect, the invention features, in general, a fuse in which terminals are retained in respective slots through end portions of a tubular insulative housing by respective pins that each pass through a hole in the terminal and holes on both sides of the terminal in the end portions of the housing.

In a preferred embodiment, the housing is made of a tubular member with two ends and two slotted end blocks located at each of the two ends of the tubular member. Each pin extends through holes at the ends of the tubular member and holes in the end blocks.

In another aspect, the invention features, in general, making an insulative fuse housing by welding together housing pieces made of thermoplastic material. This permits the fuse casing to be easily formed from molded parts that are joined together by ultrasonic welding or other techniques.

Preferably, the thermoplastic material has a continuous use temperature greater than 120° C. and includes between 20% and 40% (most preferably between 30% and 35%) filler (e.g., fiber glass). Suitable thermoplastic materials include highly crystalline Nylon 4.6, polyphthalamide, polyphenylene sulfide, and liquid crystal polymer.

Other advantages and features of the invention will be apparent from the following description of the particular embodiments thereof and from the claims.

DESCRIPTION OF PARTICULAR EMBODIMENTS

Particular embodiments of the invention will now be described.

DRAWINGS

STRUCTURE, MANUFACTURE, AND OPERATION

Figures 1, 1A:
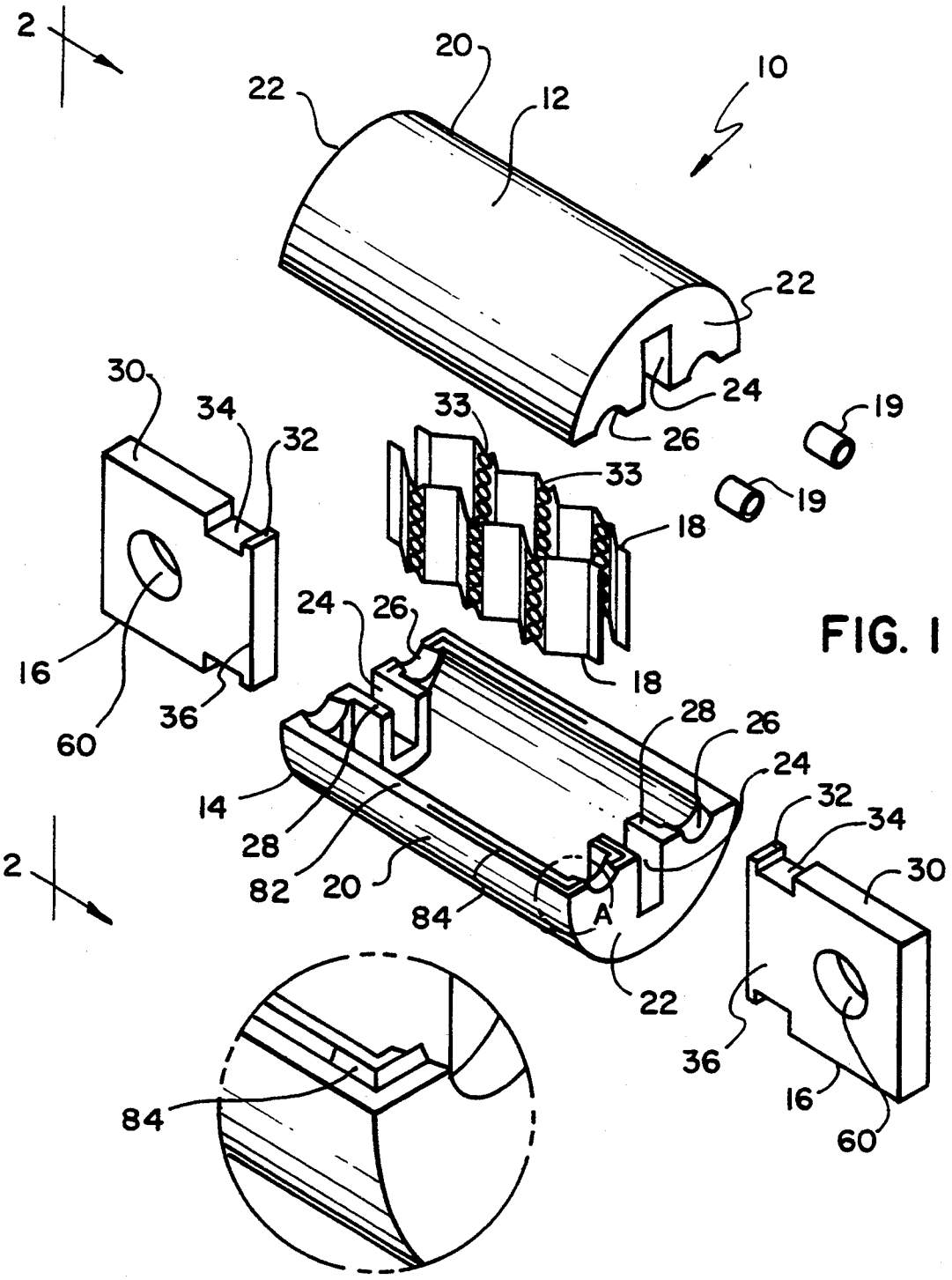
FIG. 1 is an exploded perspective view of a fuse according to the invention.
FIG. 1A is an enlarged view of the portion marked A on FIG. 1.

Referring to FIGS. 1, 1A, 2 and 3, fuse 10 includes insulative housing pieces 12, 14 made of plastic, terminals 16 made of conducting material, fusible elements 18 made of conducting material, and plugs 19. Insulative housing pieces 12, 14 have tubular portions 20 and end portions 22. End portions 22 have surfaces defining slots 24 and fill holes 26 after pieces 12, 14 have been joined together. Slots 24 extend between and are defined by wall extensions 28, which extend into the interior of the housing. The long axis of each slot 24 (in the face of each end portion 22) is perpendicular to the seam formed when the two housing pieces 12, 14 are joined. Terminals 16 include external portions 30, internal portions 32, and middle portions 34 (within slots 24). External portions 30 have holes 60. Fusible elements 18 are attached to opposite surfaces 36 of internal portions 32. Fusible elements 18 have current limiting notch sections 33 defined by rows of holes and are generally corrugated to provide a relatively larger number of notch sections 33 for a given length of housing than would be permitted if fusible elements 18 were straight.

Figure 2:
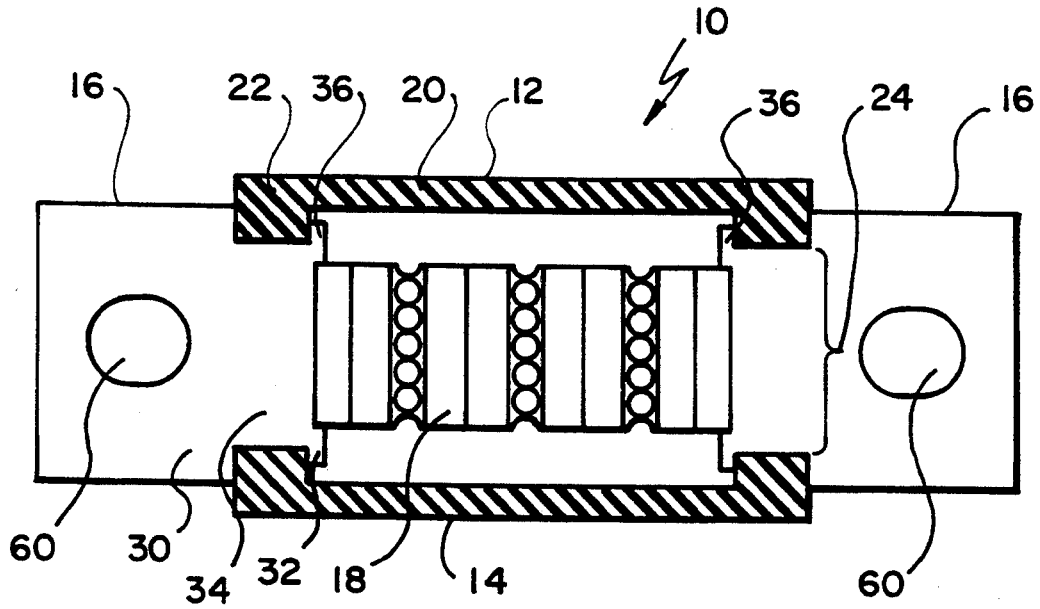
FIG. 2 is a sectional view, taken at 2—2 of FIG. 1, of the FIG. 1 fuse.
Figure 3:
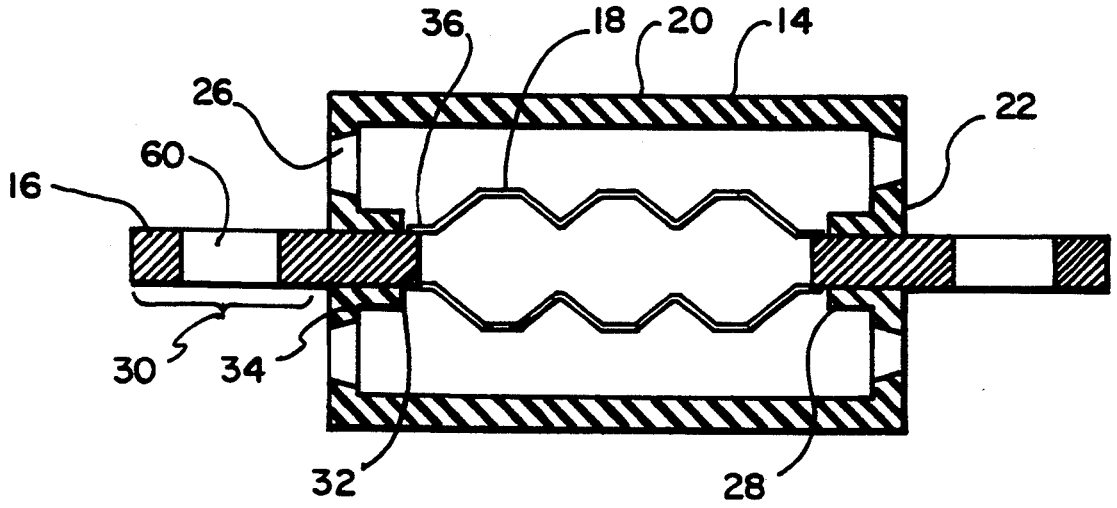
FIG. 3 is a plan view, partially in section, of components of the FIG. 1 fuse during assembly.

As shown in FIG. 2, the external portion 30 and internal portion 32 of each terminal 16 are larger than the slots 24, and the middle portion 34 is essentially the same size as the slot. This ensures that, after housing pieces 12, 14 have been joined, each terminal 16 is retained and anchored in the housing by interference between its internal portion 32 and the walls defining slot 24. Wall extensions 28 (FIG. 3) make the slots deeper and thereby increase the support of terminals 16.

In manufacture, the ends of fusible elements 18 are attached to surfaces 36 by resistance (spot or continuous) welding or ultrasonic welding. The subassembly of terminals 16 and attached fusible elements 18 is then inserted in housing piece 14. Housing piece 12 is placed in position, and pieces 12, 14 are joined to each other.

When housing pieces 12, 14 are made of thermoplastic material, they can be joined together by ultrasonic welding. As shown in FIG. 1, housing pieces 12, 14 are identical and include mating edge surfaces 82. When housing pieces 12, 14 are joined, projections 84 on one piece coincide with flat portions of edge surface 82 on the other piece. Alternatively, all projections 84 could be on one piece, and all flat portions could be on the other. Triangular projections 84 direct the ultrasonic welding energy and increase the efficiency of the welding process. When using ultrasonic welding to join housing pieces, it is preferred that the fusible elements be aligned with the direction of vibration (as in FIG. 1) and not perpendicular to it (as in the FIG. 4 embodiment discussed below).

Figure 6:
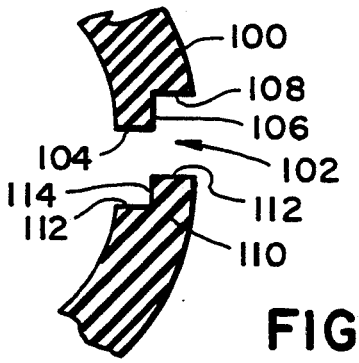
FIG. 6 is a partial sectional view showing the junction of housing pieces of the FIG. 1 fuse.

FIG. 6 shows a different joint configuration, a shear joint, which can be used along an edge and is particularly preferred for semi-crystalline material in order to obtain good joint strength. Upper piece 100 has right angle portion 102 including lower surface 104, vertical surface 106, and upper surface 108. The mating portion of lower piece 110 has similar right angle portion including lower surface 112, vertical surface 114, and upper surface 116. The other sides of pieces 100, 110 have the same mating configurations; piece 100 could have the projection defined by surfaces 104, 106 on the inside (as it is shown on FIG. 6 for the right-hand side), in which case it would be considered a male piece while piece 110 would be considered a female piece, or the projection defined by surfaces 104, 106 could be on the outside, in which case both pieces would be identical. The overall wall thickness is about 0.13" thick, and there is between 0.012" and 0.016" interference for the vertical surfaces used to permit ultrasonic welding. During such welding, lower piece 110 is fixed, and upper piece 100 is moved toward it and vibrated at 20 KHz. The material of the interfering vertical surfaces melts due to friction as the two are brought together, resulting in a shear joint that has good bond strength. Energy directing triangular projections would still be used at the ends of the tubes, owing to geometry limitations.

The thermoplastic material has the capability to be melted and reformed while retaining its properties when cooled below its melt point; this is desirable to permit joinder of preformed housing pieces by welding and to avoid the use of adhesives. The material should also have a sufficiently high continuous use temperature so as to maintain structural integrity at elevated temperatures resulting from heating when operating at rated current conditions. Preferably the continuous use temperature (UL746C, 100,000 hour test) is greater than 120° C. Fillers are preferably added to the thermoplastic resins to reduce the cost of the material and to improve the mechanical properties of the plastic by forming a support matrix within the plastic. Fillers tend to increase the continuous use temperature of the thermoplastic material, thereby providing improved structural integrity at elevated temperatures. However, depending on the resin and filler material, increasing filler concentration beyond a certain amount tends to reduce the strength; also, increasing the concentration beyond a certain amount may tend to negatively affect the ability to create strong bonds using ultrasonic welding. It accordingly is desirable to increase the continuous use temperature as much as possible while still achieving good bond strength using ultrasonic welding. Suitable filler materials include fiber glass, calcium carbonate, carbon fiber, cellulose, and graphite fiber. In general, thermoplastic materials with a continuous use temperature above 120° C. and a filler concentration between 20% and 40% (most preferably between 30% and 35%) provide necessary strength at elevated temperature while still permitting processing by ultrasonic welding. The thermoplastic material also preferably includes a flame retardant, is nontoxic (not give off toxins when it melts), and has high dielectric strength (above 400 volts/mil).

A suitable material for the thermoplastic material is glass reinforced polyphthalamide semicrystalline resin containing 33% glass filler available under the Amodel AF-1133 VO trade designation from Amoco Performance Products, Inc., Atlanta, Ga. This material includes a flame retardant and has a continuous use temperature of 125° C. per UL746C.

Other suitable materials include a highly crystalline Nylon 4.6, having 30% glass filler, and available from DSM Corp. under the Stanyl trade designation; polyphenylene sulfide having 30% glass filler and available from Phillips Corp. under the Ryton trade designation; and glass-filled liquid crystal polymers such as Xydar from Amoco, Supec from General Electric, and Vectra from Hoechst Celanese.

Also, some aspect of the inventions can be used with thermoset materials that are joined together by adhesive or solvent bonding.

The use of identical housing pieces 12, 14 reduces the part count and simplifies the manufacturing procedure. The subassembly of terminals 16 and fusible element 18 is advantageously easily installed at the same time that the housing is formed from two pieces, and the terminals are anchored without crimping, staking, welding, pinning or other techniques, owing to the fact that terminal slots 24 are defined by facing housing pieces 12, 14 and are smaller than interior portions 32.

Another technique for joining housing pieces 12, 14 together is by adhesive bonding, e.g., when the material is a thermoset plastic or also when it is a thermoplastic.

After bonding pieces 12, 14 together, the void space resulting in the housing is filled with a granular arc-quenching fill material (e.g., 50/70 or 40/60 quartz; not shown) through fill holes 26 located in the end portions of the housing. When the fuse employs a solid fill, as with sodium silicate, fill already introduced into the housing is soaked with a liquid bath of the sodium silicate, which wicks through the sand and is then cured. Solid fill is preferably employed for thermoplastic materials to provide added strength to the fuse at elevated temperatures.

Figure 4:
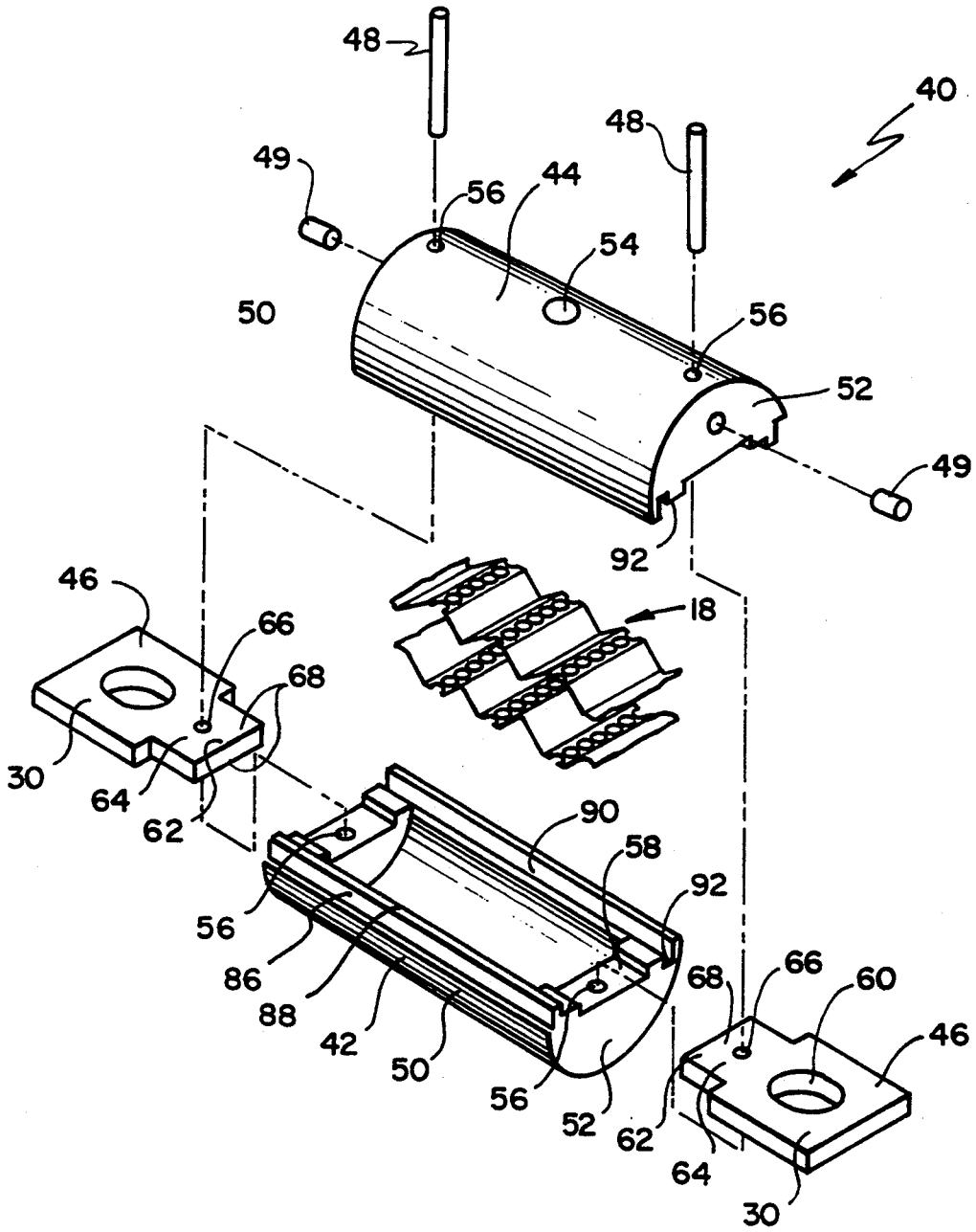
FIG. 4 is an exploded perspective view of an alternative embodiment of a fuse according to the invention.

Referring to FIG. 4, fuse 40 includes insulative housing pieces 42, 44 made of plastic, terminals 46 made of conducting material, pins 48 made of conducting material, fusible elements 18 made of conducting material, and plugs 49. Insulative housing pieces 42, 44 have tubular portions 50 and end portions 52. A tubular portion 50 has a hole 54 therethrough for receiving a blown-fuse indicator (not shown). End portions 52 include pin holes 56 and recesses that define slots 58 after pieces 50 have been joined together. The long axis of each slot 58 (in the face of end portion 52) is parallel to the seam formed when the two housing pieces 42, 44 are joined. Terminals 46 include external portions 62, internal portions 62, and middle portions 64 (within slots 58). Middle portions 64 include pin holes 66. Fusible elements 18 are attached to opposite surfaces 68 of internal portions 62. End portions 52 also have fill holes 53 therethrough for receiving fill material; holes 53 are sealed with preformed metal plugs 49 or a nonconductive potting plug.

Housing pieces 42, 44 are joined via mating grooves and projections. Housing pieces 42, 44 are identical, each having a first side edge 86 with a projection 88 and a second side edge 90 with a groove 92 arranged so that the projection 88 of the housing piece 42 fits into the groove 92 of housing piece 44 and the projection on housing piece 44 fits into the groove on housing piece 42. Alternatively, a groove 92 could be provided on both sides of one housing piece (which would then be considered the female piece) and a projection 88 could be provided on both sides of the other housing piece (which would then be considered the male piece). Housing pieces 42, 44 can be bonded together by ultrasonic welding, if made of thermoplastic material, or by adhesive bonding.

Terminals 46 are retained in the housing by pins 48 passing through pin holes 56 in the housing and pin holes 66 in the terminals. These pins also can be used to make an electrical connection to an indicator or sensor at the surface of the housing.

The housing is filled with an arc-quenching fill (not shown) through fill holes 54 located in the tubular portions of the housing. The fill can be granular or solid, as already described. Fill holes 54 are then sealed with plugs 49.

Figure 5:
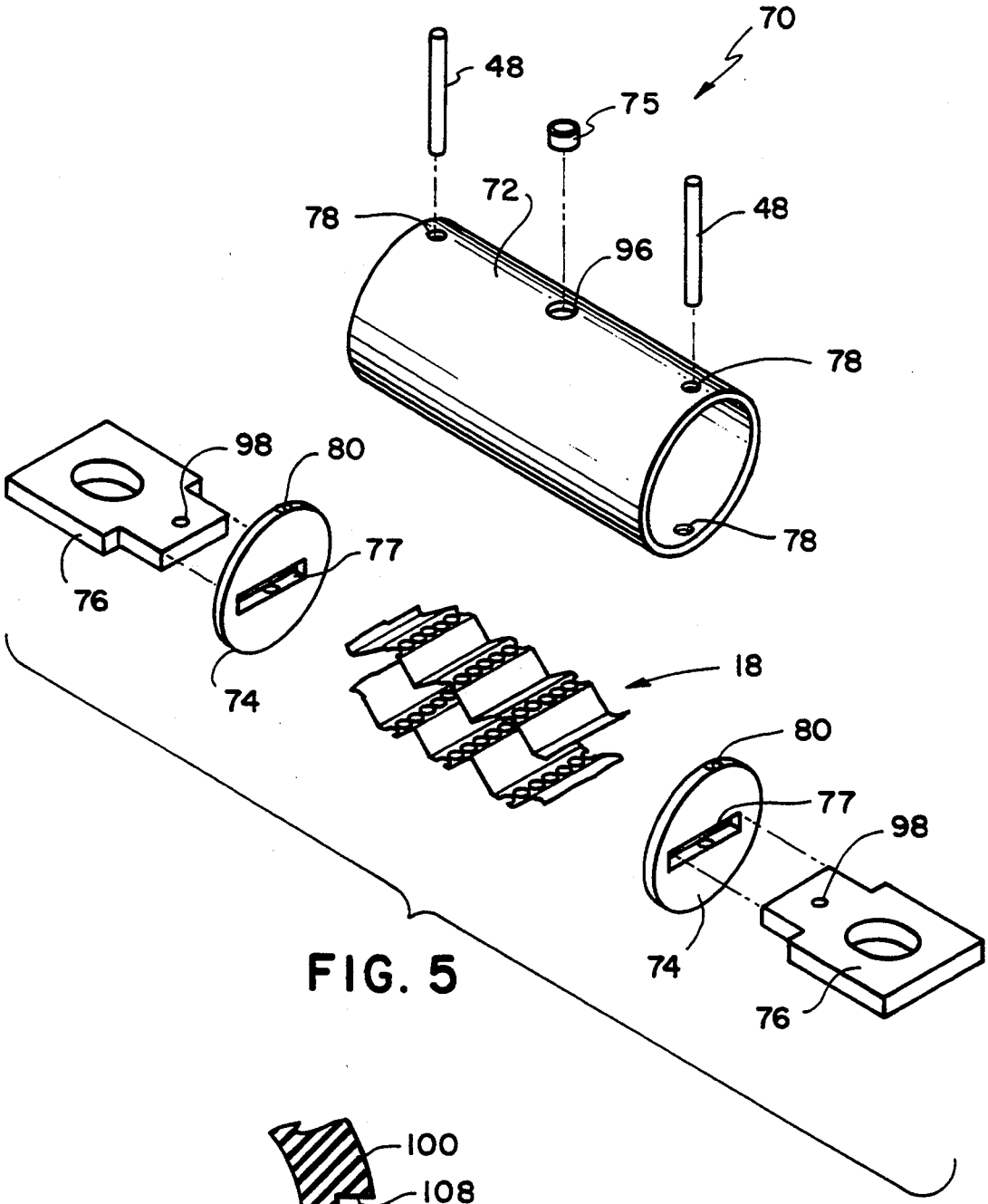
FIG. 5 is an exploded perspective view of another alternative embodiment of a fuse according to the invention.

Referring to FIG. 5, fuse 70 includes tubular housing 72 made of insulative material (e.g., a thermoset), end blocks 74 made of either conducting or insulative material, terminals 76 made of conducting material, pins 48 made of conducting material, fusible elements 18 made of conducting material, and plug 75. Tubular housing 72 has pin holes 78 (near the ends) and fill hole 96. Each end block 74 has a respective terminal slot 77 and a single pin hole 80 that extends radially through the end block, perpendicular to the long axis of slot 77.

Terminals 76 and end blocks 74 are retained in tubular housing 72 by pins 48 passing through pin holes 78, 80 in end blocks 74, and pin holes 98 in terminals 76.

The housing is filled with an arc-quenching fill (not shown) through fill hole 96 located in tubular housing 72. The fill can be granular or solid, as already described. Fill hole 96 is then sealed with plug 75.

In the embodiment shown in FIG. 5, tubular housing 72 can alternatively be made of glass melamine glass. End blocks 74 can be made of plastic.

Other embodiments of the invention are within the scope of the following claims. E.g., a particular fuse can include one or a plurality of fusible elements 18. Also, the terminals of the FIG. 5 embodiment could be insert molded in the end blocks. Also, other welding techniques can be employed; e.g., the mating faces might be heated by a source of heat (as opposed to friction) and then joined together. Also, solvent bonding could be used to join together two housing pieces. In addition to cylindrical fuse housings, other cylindrical shapes such as those having square or hexagon cross sections can be used.

What is claimed is:

1. A fuse comprising an insulative housing made from two plastic housing pieces that have been joined together, said housing including a tubular portion with two ends, and end portions located at each of said two ends of said tubular portion, each of said end portions having a slot therethrough;

terminals extending through both of said slots, each of said terminals having an internal portion inside said housing, an external portion outside of said housing, and a middle portion between said internal and external portions and located within one of said slots; and a fusible element having ends connected to respective internal portions of both of said terminals, wherein said housing is made from a thermoplastic material that has a continuous use temperature greater than 120° C. and includes 20%–40% filler, and said housing pieces are ultrasonically welded to each other.

2. The fuse of claim 1 wherein each said slot is defined by portions of both of said housing pieces.

3. The fuse of claim 2 wherein joinder of said two housing pieces forms a seam dividing each of said end portions into two sections, each of said slots has a first axis and a second axis in a plane perpendicular to a longitudinal axis of said tubular housing, said first axis being longer than said second axis and perpendicular to it, and said first axis is perpendicular to said seam.

4. A fuse comprising an insulative housing made from two plastic housing pieces that have been joined together, said housing including a tubular portion with two ends, and end portions located at each of said two ends of said tubular portion, each of said end portions having a slot therethrough;

terminals extending through both of said slots, each of said terminals having an internal portion inside said housing, an external portion outside of said housing, and a middle portion between said internal and external portions and located within one of said slots; and a fusible element having ends connected to respective internal portions of both of said terminals, wherein each said slot is defined by portions of both of said housing pieces, and wherein joinder of said two housing pieces forms a seam dividing each of said end portions into two sections, each of said slots has a first axis and a second axis in a plane perpendicular to a longitudinal axis of said tubular housing, said first axis being longer than said second axis and perpendicular to it, and said first axis is aligned with said seam.

5. The fuse of claim 1 wherein said internal portions of each of said terminals are larger than said slots, and said terminals are thereby retained in said housing by interference.

6. The fuse of claim 1 further comprising two pins, each of said pins extending through said housing and one of said terminals, wherein said terminals are retained in said housing by said pins.

7. The fuse of claim 4 wherein said housing pieces are ultrasonically welded to each other.

8. The fuse of claim 1 wherein said tubular portion is cylindrical, and said end portions are circular.

9. The fuse of claim 1 wherein said housing contains arc-quenching fill material.

10. The fuse of claim 9 wherein fill holes are located in each of said end portions, said fill holes being sealed with plugs.

11. The fuse of claim 1 further comprising wall extensions extending perpendicularly from said end portions into said housing, said wall extensions partially defining said slots.

12. The fuse of claim 1 wherein joinder of said two housing pieces forms a seam dividing said tubular portion into two sections, and said sections are joined via mating grooves and projections on said housing pieces.

13. The fuse of claim 12 wherein said housing pieces are identical.

14. The fuse of claim 1 wherein joinder of said two housing pieces forms a seam dividing said tubular portion into two sections, and said sections are joined via a shear joint.

15. The fuse of claim 14 wherein said housing pieces have interfering portions at said shear joint that have been joined by frictional heating.

16. The fuse of claim 1 wherein each of said housing pieces has side edge surfaces that contact the side edge surfaces of the other housing piece when said housing pieces are joined, at least one of said side edge surfaces has portions that include a projection, said projection having a triangular cross-section, at least one of said side edge surfaces has portions that are essentially flat, said flat portions and said projections are so arranged that, when said housing pieces are joined, said projections contact said flat portions of the other of said housing pieces.

17. The fuse of claim 15 wherein said housing pieces are identical.

18. The fuse of claim 1 wherein said housing pieces are identical.

19. The fuse of claim 4 wherein said housing is made from a thermoplastic material.

20. The fuse of claim 19 wherein said thermoplastic material includes a filler.

21. The fuse of claim 19 wherein said thermoplastic material has a continuous use temperature greater than 120° C.

22. A fuse comprising an insulative housing made from two plastic housing pieces that have been joined together, said housing including a tubular portion with two ends, and end portions located at each of said two ends of said tubular portion, each of said end portions having a slot therethrough;

terminals extending through Both of said slots, each of said terminals having an internal portion inside said housing, an external portion outside of said housing, and a middle portion between said internal and external portions and located within one of said slots; and a fusible element having ends connected to respective internal portions of both of said terminals, wherein joinder of said two housing pieces forms a seam dividing said tubular portion into two sections, and said sections are joined via a shear joint, wherein said housing pieces have interfering portions at said shear joint that have been joined by frictional heating, wherein said housing is made from a thermoplastic material, wherein said thermoplastic material comprises polyphthalamide.

23. The fuse of claim 1 wherein said thermoplastic material comprises highly crystalline Nylon 4.6, polyphenylene sulfide, polybutalene terephthalate, or liquid crystal polymer.

24. The fuse of claim 1 wherein said filler comprises fiber glass.

25. The fuse of claim 1 wherein said thermoplastic material has 30% to 35% filler.

26. The fuse of claim 1 wherein said fusible elements are resistance welded to said internal portions of said terminals.

27. The fuse of claim 1 wherein said fusible elements are ultrasonically welded to said internal portions of said terminals.

28. The fuse of claim 1 wherein each of said internal portions of said terminals has two long surfaces, two short surfaces, and an end surface, and said fusible element is connected to said two long surfaces of said internal portions of said terminals.

29. The fuse of claim 1 wherein said fusible element is corrugated.

30. The fuse of claim 1 further comprising a second fusible element having ends connected to respective internal portions of both of said terminals.

31. The fuse of claim 22 wehrein said thermoplastic material has 30% to 35% filler.

* * * * *